United States Patent [19]

Young et al.

[11] Patent Number: 4,914,477

[45] Date of Patent: Apr. 3, 1990

[54] REPRODUCTION APPARATUS HAVING AN IMAGE MEMBER WITH TIMING INDICIA

[75] Inventors: Timothy J. Young, Williamson; Fereidoon S. Jamzadeh, Fairport; David J. Reed, Reed, all of N.Y.

[73] Assignee: Eastman Kodak Company, Rochester, N.Y.

[21] Appl. No.: 270,981

[22] Filed: Nov. 14, 1988

[51] Int. Cl.[4] ..... G03G 15/00

[52] U.S. Cl. ..... 355/208; 355/212; 355/317

[58] Field of Search ..... 355/203–208, 355/212, 271, 272, 317, 326, 327; 377/18; 101/248, 181; 364/469, 561; 226/10

[56] References Cited

U.S. PATENT DOCUMENTS

| | | | |
|---|---|---|---|
| Re. 32,967 | 6/1989 | St. John et al. | 226/10 X |
| 3,594,552 | 7/1971 | Adamson et al. | 377/18 |
| 4,025,186 | 5/1977 | Hunt, Jr. et al. | 355/212 |
| 4,252,432 | 2/1981 | Ophey | 355/212 |
| 4,477,176 | 10/1984 | Russel | 355/271 X |

*Primary Examiner*—Joan H. Pendegrass
*Attorney, Agent, or Firm*—Leonard W. Treash

[57] ABSTRACT

A reproduction apparatus has an endless web with perforations or other indicia triggering image formation and receiving sheet presentation. To correct for error in perforation location the distance between perforations is measured and a delay after sensing one or both perforations is adjusted accordingly. Preferably, the distance between perforations is measured by an encoder temporarily connected to the apparatus when a new web is installed by a serviceperson.

11 Claims, 4 Drawing Sheets

REPRODUCTION APPARATUS HAVING AN IMAGE MEMBER WITH TIMING INDICIA

FIELD OF THE INVENTION

This invention relates to reproduction apparatus, and more specifically, a reproduction apparatus in which timing is controlled in response to the sensing of timing indicia on an image member.

BACKGROUND OF THE INVENTION

U.S. Pat. No. 4,025,186 to Hunt, Jr. et al is representative of a number of publications and commercial apparatus in which indicia on an endless web is used to control timing of a reproduction apparatus. In that apparatus an electrophotographic web has a series of perforations (sometimes herein called "perfs") along one edge. The perforations are sensed at a position along the path of the web and the resulting indications of the presence of a perforation are sent to a logic and control means which controls the timing of various portions of the apparatus. The logic and control means may include a clock which creates an underlying set of clock pulses which are used to control the timing of the machine. The clock is updated periodically by the indications from the sensing means.

Although timing of all stations of an electrophotographic apparatus can be controlled in response to indicia sensing, two stations, image formation and image transfer are especially critical. Use of a series of perforations has a preciseness that is dependent upon the preciseness of location of the perforations. For ordinary reproduction using either optical or electronic exposure, the accuracy of perforation location expected from the photographic industry is adequate. However, some applications require more preciseness than this ordinary perforation formation provides. For example, if successive images are to be superposed on a single surface at the transfer station to form a multicolor image, precise registration of those images governs the quality of the multicolor image. Similarly, if successive images are to be used as color separation masters in xeroprinting, lithoprinting, or the like, and if the edges of the masters are to be used for registration of such images, location of the images on the masters is more critical than ordinary perf formation provides.

A publication, *IBM Technical Disclosure Bulletin,* Vol. 28, No. 7, Dec. 1985, page 2942 describes a laser printer having a single mark on an endless photoconductor belt which is sensed to synchronize the timing of printer operations. Because of inaccuracies in the size of the belt, the distance of travel between sensing the single mark as it repeatedly passes the sensor is measured by an encoder. The encoder is then used for timing the operation of the machine. The distance measured between consecutive sensings of the mark is used to create a correction signal to adjust the timings when the mark occurs in the middle of a cycle.

This publication suggests that a single mark per belt is preferred to a mark for each frame because of problems associated with manufacturing and maintaining positional tolerance between multiple marks on a flexible belt. It also requires an encoder for continual day-to-day operation.

Other apparatus have also been suggested in the literature in which a single mark per frame is used to trigger timing with a plurality of sensors one for each operational function to be timed, see for example, U.S. Pat. No. 3,606,532, Shelfo. In these structures timing is dependent upon accurate relative location of the critical sensors.

STATEMENT OF THE INVENTION

It is an object of the invention to provide a reproduction apparatus using an image member having spaced indicia for timing, which apparatus provides very precise timing despite some imprecision in the placement of the indicia.

This and other objects are accomplished by apparatus in which a single sensor triggers more than one function in response to sensing such spaced indicia. A logic and control for such apparatus which includes means for receiving data from which the distance between the indicia can be determined as well as triggering signals from the sensor. The logic and control includes means for controlling the timing of the apparatus according to such data and the sensing of the indicia.

According to a preferred embodiment, the image member is an endless web and the apparatus includes at least one roller around which the web is trained. An encoder is attachable to the roller, for example, by a serviceperson who is installing a new web in the apparatus. The machine is run with the encoder in place and the logic and control receives from the encoder and the sensor, signals indicative of the distance between the two indicia. The logic and control then adjusts the timing of the apparatus for the actual distance measured between the indicia. The encoder can be removed from the apparatus after the adjustment to the timing is made by the logic and control for this particular web.

In this invention, preciseness in the registration of images can be obtained that will permit use of timing indicia controlled electrophotographic apparatus in making very high-quality color separation masters and very high quality multicolor images.

BEST MODE OF CARRYING OUT THE INVENTION

Figure 1:
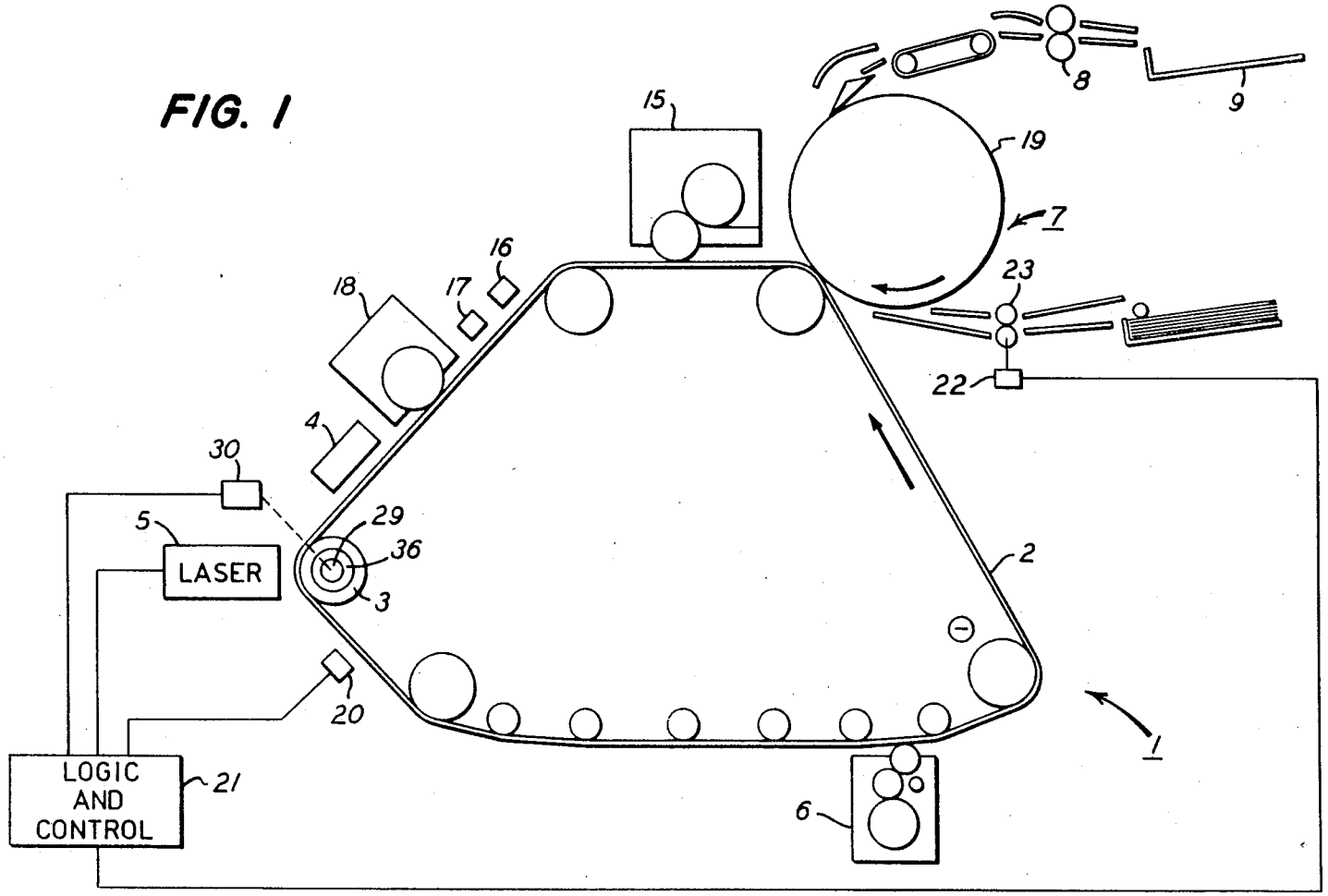
FIG. 1 is a schematic side view of a reproduction apparatus constructed according to the invention.

According to FIG. 1 a reproduction apparatus 1 is designated to make color separation masters from electronic input. An electrophotographic web 2 is trained about a series of rollers including an image formation roller 3. The web is driven in a counterclockwise direction past a series of stations. The electrophotographic web 2 commonly includes one or more photoconductive layers, a conductive layer and support. It may also include insulating layers, barrier layers and other layers well-known in the art. The web 2 is charged at a charging station 4, exposed at an exposing station including, for example, a polygon laser scanner 5 to create an electrostatic image on the web 2. The electrostatic image is toned at a toning station 6 to create a toner image which is then transferred to a receiving sheet at a transfer station 7 having a roller or drum transfer member 19. The receiving sheet with the transferred image is separated from the web and transfer member 19 and transported to a fuser 8 and hence to a receiving tray 9, all as is well-known in the art. The web is then prepared for formation of the next image. It is first cleaned at a cleaning station 15. Residual charge is eliminated by an auxiliary charger 16 and an erase lamp 17. A lubricant may be added to the web at a lubricant applicator 18, and the web is ready for reuse.

FIG. 1 shows a transfer station 7 at which the receiving sheet is presented directly to the toner image on web 2. However, this invention can also be used in known systems in which the toner image is transferred to an intermediate surface, for example, a drum or endless web, and then transferred to the receiving sheet.

Although the invention can be used in other apparatus it is particularly useful in an apparatus in which the receiving sheets are to be color separation masters which may be applied to xeroprinting, lithoprinting, or other similar apparatus to make multicolor reproductions according to the technologies of those apparatus. In the preferred embodiment shown in FIG. 1, the exposing station is a polygon laser scanner 5 capable of extremely high resolution, for example, 1200 to 2400 dots per inch. It receives input from a scanner, computer or memory, not shown, which input represents the color separations of a desired multicolor image to be formed using the separations produced by this apparatus. For example, a photographic color negative may have been scanned, with the scanner capable of converting the information in that negative to signals representative of the red, green and blue components of the original. With appropriate image processing, those signals are converted into signals representing the cyan, magenta, yellow and black color separations of the final print. These signals are fed to the laser scanner 5 at the exposing station. The exposure station then forms four electrostatic images representative of these color separations and these images are formed into four separate visible images on four separate receiving sheets as described above. The receiving sheets are then placed on a printing apparatus (not shown) and used as masters to form multicolor prints. A front and side edge of each master is used to register each master in the printing apparatus. That registration must be accurate enough to obtain a final multicolor print in which the colors are tightly in register. More specifically, to utilize the high resolution of a laser scanner producing 1200 to 2400 dots per inch requires that registration be sufficiently accurate that a single point in consecutive images all fall within a 60 micron diameter circle.

Figure 2:
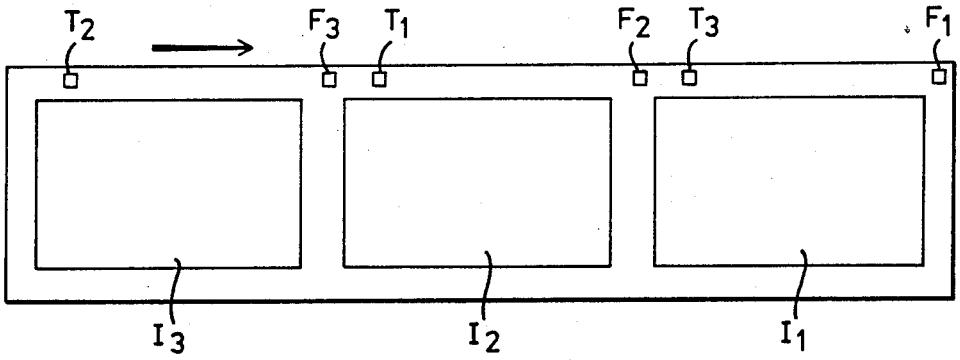
FIG. 2 is a top view of an endless web used in the apparatus shown in FIG. 1.

To obtain this extremely tight registration, the exposure station must be precisely timed with the transfer station 7. More specifically, image formation, must be precisely timed with the presentation of a receiving sheet at transfer station 7. To facilitate this timing, a sensor 20 is positioned along the path of the web 2. According to FIG. 2, web 2 has a series of perforations $F_1$, $F_2$, $F_3$ and $T_1$, $T_2$ and $T_3$ along its edge. The sensor 20 senses the leading (or trailing) edge of each perforation, and feeds an indication of that sensing to a logic and control unit 21. Logic and control unit 21 then controls the timing of image formation by triggering the start of scan of the polygon laser scanner 5 at the exposure station. Logic and control unit 21 also triggers the feeding of a receiving sheet at transfer station 7 by controlling a stepper motor 22 on two co-axial pairs of high friction feed rollers 23 to begin the feed of a transfer sheet to the transfer station 7.

More specifically, the endless web 2 is divided into three image segments denoted $I_1$, $I_2$ and $I_3$. Perforations $F_1$, $F_2$ and $F_3$ are positioned slightly in advance of image frames $I_1$, $I_2$ and $I_3$. Perforations $T_1$, $T_2$ and $T_3$ are positioned almost a frame after image frames $I_1$, $I_2$ and $I_3$, respectively. In use, the web is made endless by joining the ends in a seam. For purposes of illustration, the web is shown before the joining of the ends.

In operation, as the web passes sensor 20 the sensor sends a signal to logic and control 21 that it senses the leading edge of perforation $F_1$. Logic and control 21 then begins the start of scan associated with exposure station 5 to create an electrostatic image on the charged web 2 in image frame $I_1$. As the web progresses, perforation $F_2$ begins the start of scan for the second image in image frame $I_2$ and perforation $F_3$ triggers the start of scan for image frame $I_3$. The images are toned as described above. As perforation $T_1$ is sensed by sensor 20, logic and control unit 21 triggers clutch 22 to feed a receiving sheet to the transfer station in timed relation with the arrival of the toner image on image frame $I_1$. Similarly, perforations $T_2$ and $T_3$ trigger the feeding of transfer sheets to receive the toner images located in frames $I_2$ and $I_3$.

Figure 3:
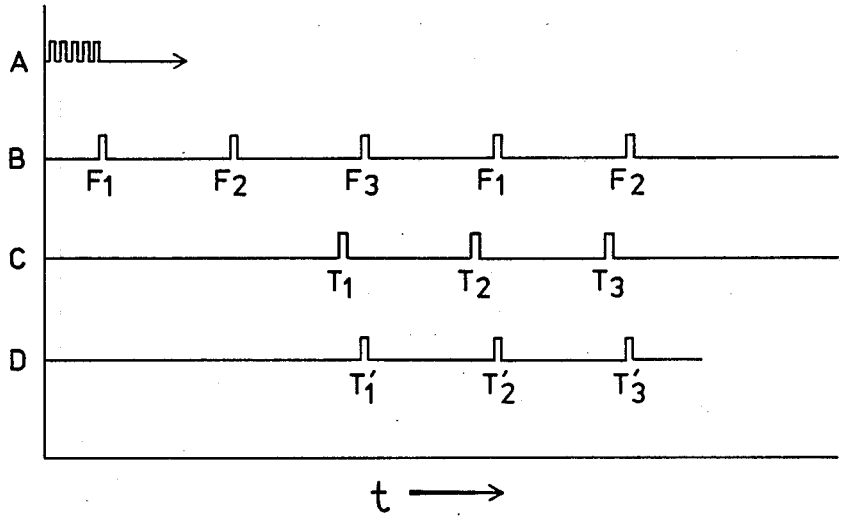
FIG. 3 is a timing chart for the apparatus constructed according to claim 1.

FIG. 3 is a timing chart which illustrates the procedure just described. Line A is a series of clock pulses generated by the logic and control unit to form the basis for all timing in the machine. Line B shows timing pulses generated in response to the sensing of the image formation perforations $F_1$, $F_2$ and $F_3$. Line C shows timing pulses generated in response to sensing perforations $T_1$, $T_2$ and $T_3$. Triggering of image formation in response to the image formation perfs $F_1$, $F_2$ and $F_3$ and triggering of receiving sheet presentation in response to sensing the sheet presentation perfs $T_1$, $T_2$ and $T_3$, in theory, could be accomplished instantaneously after receipt of the respective indication from sensor 20. However, precision of the apparatus would then be dependent upon the accuracy of the distance between $F_1$ and $T_1$, $F_2$ and $T_2$, and $F_3$ and $T_3$. Normal manufacturing tolerances in perf formation in the photographic industry, while excellent for their ordinary use, is not adequate for utilization of high resolution image formation contemplated in this apparatus. Further, the length of the web cannot be controlled to this required accuracy, and the seam would pass the sensor between at least $F_3$ and $T_3$.

Figure 4:
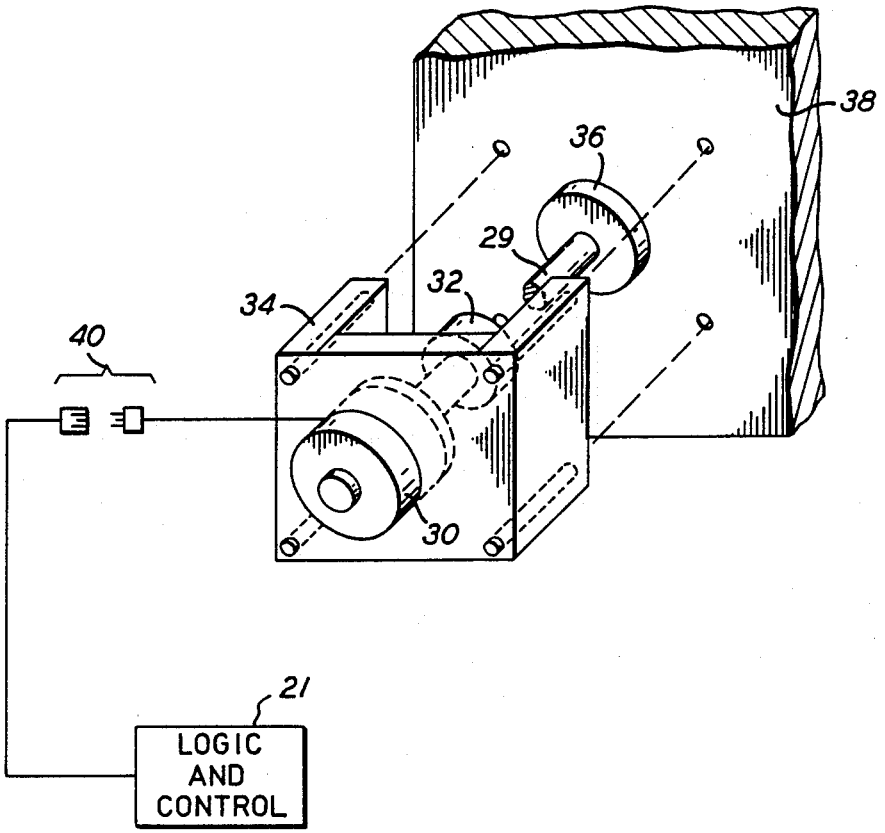
FIG. 4 is a perspective view of a couplable encoder and a receiving portion of the apparatus shown in FIG. 1.

Referring to FIGS. 1 and 4, to solve this problem, image formation roller 3 includes means, for example, couplable shaft extension 29, for receiving an encoder 30. When the serviceperson installs a new web in the apparatus, encoder 30, supplied by the serviceperson, is coupled to shaft extension 29 by a suitable flexible coupling 32. A housing 34 supporting encoder 30 is temporarily attachable to a support plate 38 for bearings 36 for the roller 3 (FIG. 1). The encoder is electrically connectable to the logic and control 21 through a suitable connection 40. With the new web 2 and the encoder 30 in place the machine is turned on. With the machine running, encoder pulses are relayed from encoder 30 back to logic and control 21. These encoder pulses represent the angular displacement of roller 3 which can be converted into a distance along web 2. Logic and control 21 then counts encoder pulses between sensor signals indicating the passage of perforations $F_1$ and $T_1$, $F_2$ and $T_2$, and $F_3$ and $T_3$. In a perfect system each of these 3 distances should be the same and the logic and control 21 should count the same number of encoder pulses for each of these distances. However, due to the manufacturing tolerances associated with perforation formation, mentioned above, these distances will not be equal, nor will they be equal to an appropriate nominal distance. To correct for these inherent errors, logic and control 21 compares the number of encoder pulses counted and adjusts the triggering of stepper motor 22 accordingly. More specifically, a delay is built into the system between the sensing of perforations $T_1$, $T_2$ and $T_3$ and the actual triggering of the stepper motor for the feeding of the appropriate receiving sheets. This is shown in FIG. 3, line D where the actual triggering of motor 22 is shown as $T_1'$, $T_2'$ and $T_3'$. The amount of the delay between $T_1$ and $T_1'$ is adjusted according to the measured distance between $F_1$ and $T_1$ as measured by the encoder 30.

For example, if the desired distance between $F_1$ and $T_1$ is 5,000 encoder pulses and the measured distance is 4,980 encoder pulses, then the distance between $T_1$ and $T_1'$ must be increased by a length of time equivalent to 20 encoder pulses. If, at the ordinary speed of the machine, one encoder pulse occurs every 10 clock pulses, then the number of clock pulses between $T_1$ and $T_1'$ should be increased by 200. If the nominal delay built into the system between $T_1$ and $T_1'$ is 500 clock pulses then the delay between $T_1$ and $T_1'$ for this particular web would be 700 clock pulses.

Note that, within reason, the nominal distance is not critical, providing all three distances are the same. Thus, any of the three distances could be taken as nominal and the other two adjusted to it. Thus, if $F_1-T_1$ is 4980 pulses, $F_2-T_2$ is 4974 pulses and $F_3-T_3$ is 4970 pulses, then $T_1$ could trigger sheet feed with a nominal delay, $T_3$ could trigger sheet feed with a delay of $10\times10=100$ clock pulses more than nominal and $T_2$ with a delay of $10\times6=60$ clock pulses more than nominal. Nominal could, of course, be zero.

The encoder is used during set-up and is removed when finished and can be used by the serviceperson with other machines. The machine itself therefore does not require the expense of the encoder. The encoder is used rather than just measuring the time between the passage of the two perfs against a nominal time, because the encoder is not subject to variances in the speed of the machine which could well be substantially beyond the tolerances of this system for such precise work.

Using this system, timing is not heavily dependent upon uniformity of machine speed providing it does not vary substantially over the period between $T_1$ and $T_1'$ (or $F_1$ and $F_1'$), which time is short so that it has negligible effect in the accuracy of location of the final image on the receiving sheet.

Alternatively, the delay could be incorporated between the sensing of the F perforation ($F_1$) and the beginning of image formation $F_1'$ (not shown). This delay between $F_1$ and $F_1'$ could be adjustable to make the same correction. Of course, both delays could be used, each absorbing a portion of the correction. This latter approach would make the apparatus less sensitive to web speed changes during either delay.

Figure 5:
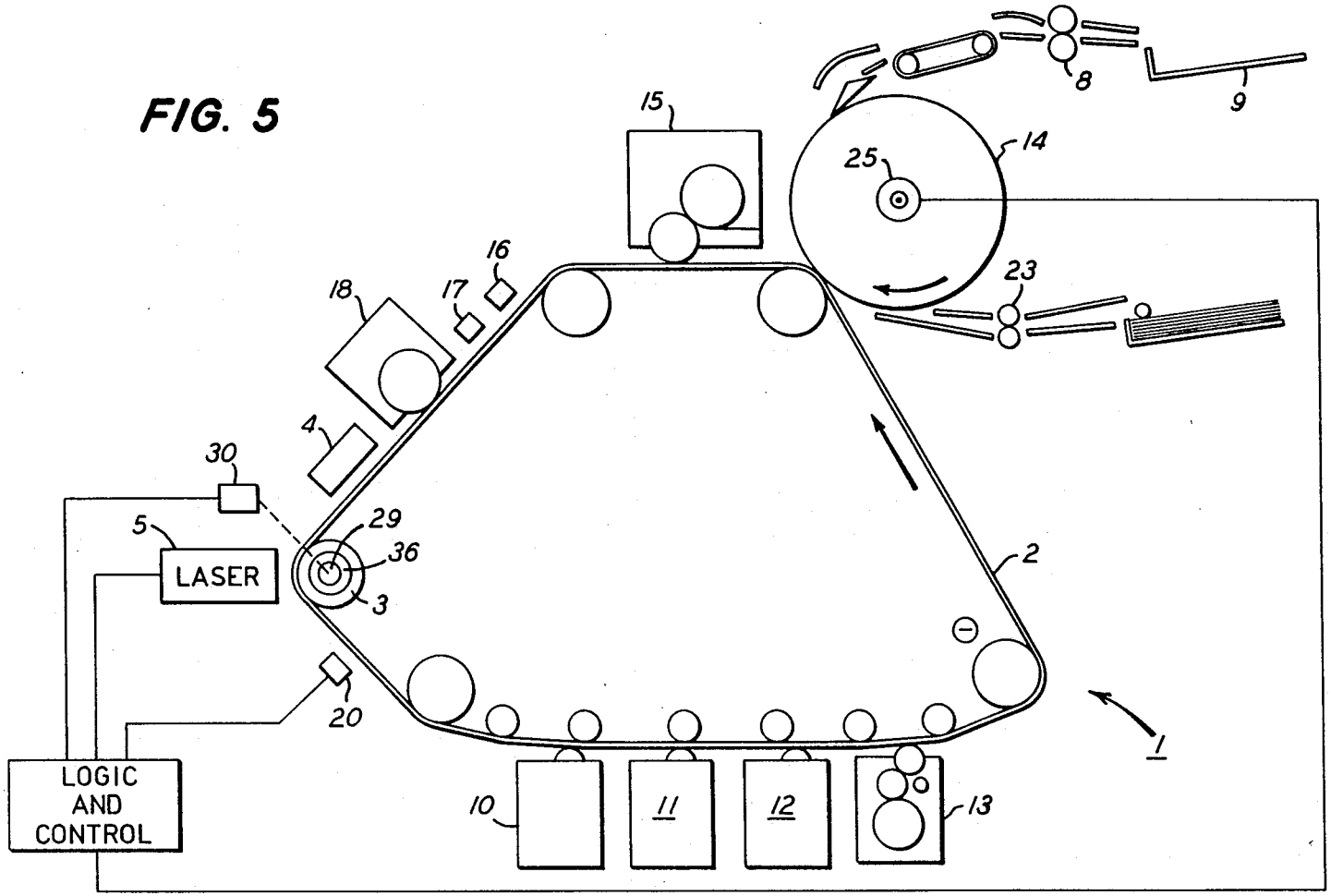
FIG. 5 is a schematic side view of a reproduction apparatus constructed according to an alternative embodiment of the invention.

Although the invention has been described with respect to an apparatus using a single toner station to make color separation masters, another application of the invention is the creation of several color images that are, in fact, superposed at transfer station. This embodiment is illustrated in FIG. 5. In this embodiment several, for example, four, toner stations 10, 11, 12 and 13 are employed toning consecutive color separation electrostatic images with different color toners, for example, cyan, magenta, yellow and black. They are transferred in registry to the surface of an intermediate transfer drum or to a receiving sheet carried by a transfer drum 14, both of which systems are well known in the art. In this embodiment, the T-perforation controls the rotation of the transfer drum itself to present the receiving surface at a precisely accurate time to register each transferred image on the preceding image. For example, the transfer drum can be driven by a stepper motor 25 controlled by the logic and control 21 as triggered by each T-perf. The stepper motor would control the rotation of the transfer drum 14, rotating it with the movement of the web while each image is being transferred and adjusting for the next T-perf signal between frames.

Although it would give up a cost saving feature, the encoder could be a permanent part of the apparatus. In such an embodiment, ordinary operation could be accomplished in response to the encoder rather than the logic and control clock and the delay between $T_1$ and $T_1'$ would be measured by encoder pulses which represent a distance along the web rather than a time.

Although the invention has been described with regard to specific frames on the web, in fact, the frames are not actually visible and are defined by the location of the F-perfs and by the logic and control means 21 which controls the location of the image with respect to the F-perfs.

Although the invention has been described with regard to perforations in the web 2 those perforations can be replaced by other indicia, for example, conductive, magnetic or optically sensible markings.

The invention is clearly most useful with endless web type apparatus, because of inherent inaccuracies in perf placement in webs. However, it can also find use with drum image members where the quality of image registration desired exceeds the accuracy of timing indicia placement on the drum.

Further, although the invention is described with regard to image formation steps and copy sheet presentation steps of an electrophotographic apparatus, it can be used for other stations in other types of apparatus requiring precise timing, for example, electrographic reproduction apparatus.

The invention has been described in detail with particular reference to a preferred embodiment thereof, but it will be understood that variations and modifications can be effected within the spirit and scope of the invention as described hereinabove and as defined in the appended claims.

We claim:

1. A reproduction apparatus comprising:

means for transporting an image member through a path, said member having at least one image frame and at least two spaced indicia for each frame, means for sensing such indicia as said indicia passes a position in the path, means for initiating formation of an image in timed relation to the sensing of a first of said indicia, means for transferring the image so formed to a receiving surface in timed relation to the sensing of a second of said indicia, logic and control means for controlling the timing of said apparatus, said logic and control means including means for receiving data from which the distance between the first and second indicia can be determined and for controlling the timing of said apparatus according to such data and the sensing of said indicia.

2. A reproduction apparatus comprising:

means for transporting an endless web image forming member through a web path, said web having a plurality of image frames and at least two spaced indicia for each frame, means for sensing such indicia as said indicia passes a position in the web path, means for initiating formation of an image in said frame in timed relation to the sensing of a first of said indicia, means for transferring the image so formed to a receiving surface including means for presenting the receiving surface to the image in timed relation to the sensing of a second of said indicia, logic and control means for controlling the timing of said apparatus, said logic and control means including means for receiving data from which the distance between the first and second indicia can be determined and for controlling the timing of said apparatus according to such data and the sensing of said indicia.

3. A reproduction apparatus according to claim 2 wherein said apparatus includes means for receiving a means for generating data indicative of the distance of movement of said web, and said logic and control means is connectable to a received data generating means, and includes means for receiving said generated data and indications of the sensing of the first and second indicia and for determining the distance between said indicia in terms of said generated data.

4. The apparatus according to claim 3 wherein said apparatus includes at least one roller around which said web is trained and said means for receiving a means for generating data is a means associated with said roller for receiving an encoder for measuring the angular displacement of said roller.

5. A reproduction apparatus according to claim 2 wherein said logic and control means includes means for delaying the presentation of the receiving surface to the image for said transfer for a predetermined time after sensing of said second indicia and wherein said predetermined time is adjustable by said logic and control means according to the data received indicative of the actual distance between the first and second indicia.

6. A reproduction apparatus comprising:

means for transporting an endless web electrophotographic member through a web path, said member having a plurality of image frames and at least two spaced indicia for each frame, means for sensing such indicia as said indicia passes a position in the web path, laser means for forming an electrostatic image in said frame, means for initiating formation of an electrostatic image in said frame by said laser means in timed relation to the sensing of a first of said indicia, means for toning said electrostatic image to form a toner image, means for transferring the toner image to a receiving sheet including means for transporting a receiving sheet into transfer relation with said toner image in timed relation to the sensing of a second of said indicia, and logic and control means for controlling the timing of said apparatus, said logic and control means including means for receiving data from which the distance between the first and second indicia can be determined and for controlling the timing of said apparatus according to such data and the sensing of said indicia.

7. A reproduction apparatus comprising:

means for transporting an endless web image forming member through a web path, said web having a plurality of image frames and at least two spaced indicia for each frame, means for sensing such indicia as said indicia passes a position in the web path, means for performing a first function with respect to said frame in timed relation to the sensing of a first of said indicia, means for performing a second function with respect to said frame in timed relation to the sensing of a second of said indicia, logic and control means for controlling the timing of said apparatus, said logic and control means including means for receiving data from which the distance between the first and second indicia can be determined and for controlling the timing of said apparatus according to such data and the sensing of said indicia.

8. A reproduction apparatus generally of the type in which a succession of images are formed on an image member, which images represent the color separations of a single multicolor image, and in which apparatus the images representing said successive color separations are to be transferred with precise positional accuracy from image to image, said apparatus comprising:

means for transporting an endless web image forming member through a web path, said web having a plurality of image frames and at least two spaced indicia for each frame, means for sensing such indicia as said indicia passes a position in the web path, means for initiating formation of an image in a particular frame in timed relation to the sensing of a first of said indicia, means for transferring an image formed by said apparatus to a receiving surface in timed relation to the sensing of a second of said indicia, logic and control means for controlling the timing of said apparatus, said logic and control means including means for receiving data from which the distance between the first and second indicia can be determined for each frame and for controlling the timing of said apparatus according to such data and the sensing of said indicia so that the image formation and transfer steps are triggered with identical timing for said plurality of frames.

9. A reproduction apparatus according to claim 8 wherein said logic and control means includes means for delaying the transferring step for a predetermined time after sensing of said second indicia and wherein said predetermined time is adjustable by said logic and control means according to the data received indicative of the actual distance between the first and second indicia for all the frames.

10. The apparatus according to claim 9 wherein said apparatus includes means for forming different color images in said frames and wherein said transfer means includes means for presenting a receiving surface to a plurality of images to receive said images in registration to form a multicolor image.

11. A reproduction apparatus comprising:

means for transporting an endless web electrophotographic member through a web path, said web having a plurality of image frames and at least two spaced indicia for each frame, means for sensing such indicia as said indicia passes a position in the web path, means for initiating formation of an electrostatic image in said frame in timed relation to the sensing of a first of said indicia, means for applying a different colored toner to each of a plurality of images so formed, means for transferring each of a plurality of images so formed to a single receiving surface in registration to create a multicolor image, including means for presenting the receiving surface to the image in timed relation to the sensing of a second of said indicia with respect to each frame, logic and control means for controlling the timing of said apparatus, said logic and control means including means for receiving data from which the distance between the first and second indicia can be determined and for controlling the timing of said apparatus according to such data and the sensing of said indicia.

* * * * *